US010006743B2

(12) United States Patent
Mitnick

(10) Patent No.: US 10,006,743 B2
(45) Date of Patent: Jun. 26, 2018

(54) PROTECTIVE MATERIAL

(71) Applicant: Mitnick Capital LLC, Englewood, NJ (US)

(72) Inventor: Neal Mitnick, Staten Island, NY (US)

( * ) Notice: Subject to any disclaimer, the term of this patent is extended or adjusted under 35 U.S.C. 154(b) by 0 days. days.

(21) Appl. No.: 13/867,677

(22) Filed: Apr. 22, 2013

(65) Prior Publication Data

US 2014/0141675 A1 May 22, 2014

Related U.S. Application Data

(60) Provisional application No. 61/636,665, filed on Apr. 22, 2012.

(51) Int. Cl.

| | |
|---|---|
| ***F41H 1/02*** | (2006.01) |
| ***F41H 5/04*** | (2006.01) |
| ***A43B 3/00*** | (2006.01) |

(52) U.S. Cl.

CPC ..... *F41H 5/0471* (2013.01); *A43B 3/0026* (2013.01); *F41H 1/02* (2013.01); *Y10T 428/3192* (2015.04); *Y10T 428/31562* (2015.04); *Y10T 428/31587* (2015.04); *Y10T 428/31663* (2015.04);

(Continued)

(58) Field of Classification Search

CPC ..... A41D 27/12; A41D 31/0016; A41D 2500/20; A41D 2500/30; A41D 2500/54; B32B 5/022; B32B 5/024; B32B 5/28; B32B 15/08; A43B 13/38; F41H 5/04; F41H 5/0471

USPC ..... 2/1, 2.5, 61, 911; 36/83, 43, 44; 89/36.01, 36.02, 36.04, 901, 915, 921, 89/922, 939; 252/601; 428/295.1, 297.4, 428/423.5, 424.8, 476.9, 447, 474.4, 428/474.9, 492, 518, 520, 523, 911; 442/1, 29, 43, 59, 123, 134, 135, 164, 442/168, 169, 286, 301, 326, 394

See application file for complete search history.

(56) References Cited

U.S. PATENT DOCUMENTS

| | | | |
|---|---|---|---|
| 4,522,871 | A | 6/1985 | Armellino, Jr. et al. |
| 4,793,075 | A | 12/1988 | Thatcher |

(Continued)

OTHER PUBLICATIONS

How to Adhere Kevlar to Rubber by Sarah Davis Published by eHow.com at http://www.ehow.com/how_7683694_adhere-kevlar-rubber.html Uploaded Mar. 17, 2011, copyright 1999.

(Continued)

*Primary Examiner* — Arti Singh-Pandey

(57) ABSTRACT

A material that is capable of stopping high-speed projectiles but yet is sufficiently flexible for use in various applications, such as to be used in footwear to protect a person's feet, especially the bottoms thereof is achieved by an enhanced ballistic material formed from interleaving layers of a ballistic material and layers of a gel matrix material that remains relatively soft and flexible. The ballistic material layer may be high tensile strength synthetic or polymeric fibers that are arranged in a mesh weave. Preferably the gel matrix material is capable of investing the ballistic material, e.g., by having the gel matrix material fill the interstices of the fibers, which may be achieved through the use of heat and/or pressure. Furthermore, the combined material, i.e., the enhanced ballistic material, may be shaped, e.g., by molding.

18 Claims, 3 Drawing Sheets

(52) U.S. Cl.
CPC ..... *Y10T 428/31725* (2015.04); *Y10T 428/31732* (2015.04); *Y10T 428/31757* (2015.04); *Y10T 428/31826* (2015.04); *Y10T 428/31928* (2015.04); *Y10T 428/31938* (2015.04); *Y10T 442/3976* (2015.04)

(56) References Cited

U.S. PATENT DOCUMENTS

| | | | | |
|---|---|---|---|---|
| 4,830,245 | A | 5/1989 | Arakaki | |
| 4,944,974 | A * | 7/1990 | Zachariades | A61L 27/507 428/36.1 |
| 5,160,472 | A * | 11/1992 | Zachariades | A61L 27/16 264/136 |
| 5,285,583 | A | 2/1994 | Aleven | |
| 5,567,498 | A * | 10/1996 | McCarter et al. | 428/113 |
| 5,854,143 | A * | 12/1998 | Schuster et al. | 442/135 |
| 5,979,081 | A | 11/1999 | Vaz | |
| 5,996,255 | A | 12/1999 | Ventura | |
| 6,151,803 | A | 11/2000 | Charles | |
| 6,167,639 | B1 | 1/2001 | Ventura | |
| 6,276,255 | B1 * | 8/2001 | Field | F41H 5/0485 2/2.5 |
| 6,313,396 | B1 | 11/2001 | Glenn | |
| 6,485,446 | B1 * | 11/2002 | Brother | A41D 13/06 2/455 |
| 6,737,368 | B2 * | 5/2004 | Chiou | 442/134 |
| 7,225,878 | B2 * | 6/2007 | Holcomb et al. | 166/369 |
| 7,458,103 | B2 * | 12/2008 | Citterio et al. | 2/2.5 |
| 7,608,314 | B2 * | 10/2009 | Plant | 428/86 |
| 7,964,518 | B1 * | 6/2011 | Bhatnagar | B32B 5/26 2/2.5 |
| 8,082,685 | B2 | 12/2011 | Sartor et al. | |
| 8,490,213 | B2 * | 7/2013 | Neal | 2/2.5 |
| 8,618,004 | B2 * | 12/2013 | Kubota | 442/133 |
| 2002/0034624 | A1 * | 3/2002 | Harpell | D04H 3/04 428/298.1 |
| 2004/0139529 | A1 * | 7/2004 | Herbert | A41D 19/0065 2/167 |
| 2006/0143767 | A1 * | 7/2006 | Yang et al. | 2/16 |
| 2006/0234572 | A1 * | 10/2006 | Wagner et al. | 442/59 |
| 2012/0160086 | A1 * | 6/2012 | Carbajal | F41H 5/0485 89/36.02 |
| 2013/0112071 | A1 * | 5/2013 | Bhatnagar | F41H 5/0485 89/36.02 |
| 2013/0213208 | A1 * | 8/2013 | Compton | F41H 5/0478 89/36.02 |
| 2015/0082976 | A1 * | 3/2015 | Meldner | F41H 1/02 89/36.02 |

OTHER PUBLICATIONS

Kevlar Thickness Published by www.dimensionsinfo.com at http://www.dimensionsinfo.com/kevlar-thickness/ Author unknown, downloaded Dec. 22, 2013 upload date unkown.

Steel Helmets Fading Away—published Dec. 11, 1983 by NewsOK.com at http://newsok.com/steel-helmets-fading-away/article/2049997—Author unknown, upload date unknown.

A History of Body Armor—Bullet Proof Vests published About.com @ http://inventors.about.com/library/inventors/blforensic3.htm author & upload date unknown downloaded Dec. 22, 2013.

What Is Kevlar? Types of Kevlar by V. Ryan © 2011 upload date unknown http://www.technologystudent.com/joints/kevlar2.html publisher technologystudent.com downloaded Aug. 21, 2015.

Liquid Armor (video on YouTube)—http://www.youtube.com/watch?v=rYlWfn2Jz2g, Uploaded on Jan. 9, 2009—Autogenerated transcript attached.

* cited by examiner

PROTECTIVE MATERIAL

CROSS-REFERENCE TO RELATED APPLICATION

This application claims the benefit of (priority to) U.S. Provisional Application No. 61/636,665 filed on Apr. 22, 2012 (with EFS ID 12598980 and Confirmation Number 1001).

BACKGROUND OF THE INVENTION

It is well known that high-speed projectiles, such as those launched in response to an explosion, can cause significant injuries to people whom the projectiles encounter. For example, when a planted mine explodes due to a person walking over it, the person often receives significant injuries to his feet, legs, and torso as a result of shrapnel and other particles that are projected at high speed due to the explosion and which pass through the person's footwear and the bottom of the person's feet.

Typical materials for stopping high-speed projectiles, such as those used in armored vehicles or conventional bulletproof vests are not flexible and so are unsuitable for use in footwear to protect a person's feet, especially the bottoms thereof.

SUMMARY OF THE INVENTION

I have recognized that a material that is capable of stopping high-speed projectiles but yet is sufficiently flexible for use in various applications, such as to be used in footwear to protect a person's feet, especially the bottoms thereof, may be achieved, in accordance with the principles of the invention, by an enhanced ballistic material formed from interleaving layers of a ballistic material and layers of a gel matrix material that remains relatively soft and flexible. The ballistic material layer may be high tensile strength synthetic or polymeric fibers that are arranged in a mesh weave, each layer of which I call a "weave layer". Each layer of the gel matrix material is what I call a "gel layer". Preferably the gel matrix material is capable of investing the ballistic material, e.g., by having the gel matrix material fill the interstices of the fibers, which may be achieved through the use of heat and/or pressure. Furthermore, the combined material, i.e., the enhanced ballistic material, may be shaped, e.g., by molding.

Advantageously, the gel matrix material enhances the stopping power of the resulting multi-layer structure as compared to the same number of weave layers without gel matrix material and yet the resulting multi-layer structure is sufficiently flexible to be comfortable when inserted as in insert in a boot.

The weave layer may be made up of a) a woven para-aramid, such as KEVLAR®, hereinafter referred to as Kevlar, b) TWARON®, a woven para-aramid, c) an ultra high molecular weight polyethylene (UHMWPE), such as SPECTRA SHIELD®, or d) any mesh weave made to have similar properties. It may also be possible to employ as the weave layer ballistic plastics, or other ballistic materials that are not woven. All of the weave layers of a piece of enhanced ballistic material need not be made of the same material or be of the same thickness.

The gel matrix material may be an elastomer, e.g., an elastic polymer or natural rubber, in that it should be a material that is compressible, flexible, and elastic. For ease of manufacturing, the gel matrix material may be a thermoplastic. Exemplary gel matrix materials include ethylene vinyl acetate, (CAS# 24937-78-8, also known as EVA), neoprene, silicone, rubber, nylon, latex, ELASTOSIL® R 750, a silicone rubber product of Wacker silicones (available at http://www.wacker.com/cms/en/global$_{13}$ contents/search/searchk.jsp), polyvinylchloride (PVC), polyether, or polyurethane. Those of ordinary skill in the art will be able to select an appropriate gel matrix material based on the compressibility, flexibility, and thermal properties of the application to which the enhanced ballistic material is to be put. All of the gel layers of a piece of enhanced ballistic material need not be made of the same material or be of the same thickness.

In some layers of conventional bullet proof vests, and the like, a projectile may pass through a layer by enlarging a gap between the fibers, either by tearing some fibers or stretching the fibers, to create, at least temporarily, a space for the projectile to pass through. By contrast, in one embodiment of the invention, where the weave layer is permeable to the gel material, e.g., due to there being some space between adjacent fibers of the weave layer, the weave layer is impregnated with the gel matrix material so as to reduce the ability of the fibers to quickly separate from each other, thus increasing resistance to the motion of the projectile. The impregnation may be achieved by heating and pressing the interleaved weave layers and gel layers together.

In one embodiment of the invention, the material is shaped into shoe insert, e.g., for insertion into a soldier's boots. Typically such insert is place between the bottom of the foot, or portion of the sock surrounding the bottom of the foot, and the inside bottom portion of the shoe. Indeed, such inserts may be provided integrally with each boot of a pair of boots, provided concurrently with the boots, or they may be a so-called "after-market" product or accessory that is available for purchase for insertion into completed boots that are purchased separately, e.g., as a retrofit to existing boots. Preferably, at least the bottom layer, with respect to a foot under which the material is located, is a weave layer. Also, preferably, the outer rim around the insert is sized so that it comes up to partly envelop the soldier's foot when it is inserted into a boot containing the insert. To this end, it is advisable that the boot be sized so that it is somewhat, e.g., a half size, larger than the boot size that the soldier would otherwise wear. To protect a soldier's foot against the risk of fire in the event of an explosion underfoot, the gel matrix material employed in the various gel layers is preferably fireproof or at least the layer against the soldier's foot should preferably be a fire resistant weave layer, such as Kevlar.

For the wearer's comfort, it is possible to use in the layer that is up against the wearer's foot a material that provides odor and antibacterial protection such as MICROBAN® protection products which are available from Microban International Ltd., a global technology company headquartered in North America with an office located at 11400 Vanstory Drive, Huntersville, N.C. 28078, United States; Tel: +1 (704) 875-0806; and a website at www.microban.com.

As noted above, functionally, the impregnation of the individual fibers of the weave layers by the gel matrix material reduces the ability of a projectile to stretch and/or spread apart such individual fibers at and around the point of impact, thus making it more difficult for the projectile to part or break the fibers and so enhancing the resistance of each weave layer to the motion of the projectile. In other words, effectively the layers of gel matrix material reduce the range of motion of the weave layers because they are bound together as a whole combined unit. Furthermore, the various layers of gel matrix material cause the weave layers to at least partially work together in stopping the projectile. This may also contribute to better resistance to the spin of the projectile through the cooperation of all the joined layers.

Because the gel matrix material is elastic, the gel matrix material may also reflect the forward compressive shock-wave back at the projectile, thus working to slow the projectile.

Additionally, the gel matrix material provides some spacing between adjacent weave layers. This spacing may be small. However, such spacing prevents the weave layers from pushing against each other as quickly as if there was no space between them at all, thus allowing each layer of weave material to operate at least somewhat independently in contributing to the slowing of the projectile, thereby sapping the kinetic energy of the projectile in a layer-by-layer fashion and thus improving stopping power. This is different than when there are simply multiple adjacent weave layers, because in that situation the projectile forces a more-in-front layer further back and adjacent to the next-further-back layer, thereby eliminating any space that there may originally have been between them, reducing the effective stopping power.

Furthermore, the gel matrix material reduces the deformation rate achievable by each of the weave layers, thus allowing each of the weave layers to more strenuously resist the projectile and thereby slowing it more than each weave layer would achieve by itself. Additionally, the gel matrix material retards the ability of each subsequent weave layer to be dragged through the hole path created by the impact from layer to layer of the projectile, as compared to independent layers of weave material, which often happens for some layers typically after the first few in multi-layer stopping arrangements.

Advantageously, the inventive material further contributes to shielding the wearer's foot from heat that can cause bodily injury, such as burns, melting of flesh, and fusing of flesh to clothing and footwear. Such heat is typically generated in proximity to an explosion, which may launch high-speed projectiles, or may be the result of fires.

The enhanced ballistic material could also be used for vehicle floor mats, e.g., for school buses, armored vehicles, cars, trucks, Humvees, boats, trains, plains, and the like, to protect such vehicles from explosions, e.g., mines or improvised explosive devices (IEDs). The enhanced ballistic material also may be used to line the interior of such vehicles. Doing so would protect against penetration by depleted projectiles or chunks of shrapnel from the projectile or armor which might otherwise fly around the crew compartment. When so used the enhanced ballistic material would provide some cushioning as compared to hard steel interior surfaces that would otherwise be exposed. This could be especially useful when the vehicle travels over uneven surfaces, thereby creating a bumpy ride which tends to cause the crew to collide with the walls and ceiling.

Other applications may include use of the enhanced ballistic material as a) the inner liner of a helmet; b) a liner for a vest; c) part of the protective suit worn by tank personnel, e.g., as a replacement for one or more layers thereof; d) an elbow or knee pad, e) an ankle protector, f) an arm pit protector, h) a face mask, i) a space suit liner; j) a space craft wall, e.g., to provide interior or exterior, protection; k) a seat cushion, l) a hull, or liner thereof, of a watercraft, m) a fuselage, or liner thereof, of an aircraft, or n) part of a wetsuit or dry suit, o) the like where protection is required but some degree of softness and/or flexibility would be desirable. Note that an advantage of using the enhanced ballistic material in space applications is that the matrix material can be made airtight and one or more of the inner layers can remain airtight even after the stopping of small bits of space debris by the outer layers.

Tests have shown that while it takes 12 layers of conventional Kevlar to stop a 22 caliber long rifle hypervelocity bullet, such a bullet can be stopped by 4 to 6 layers of enhanced ballistic material, e.g., 6 layers of Kevlar and 5 layers of silicon. Thus, advantageously, not only is the enhanced ballistic a) material more comfortable due to its flexibility and b) better suited to be in close contact with the body, but it is also significantly stronger than conventional Kevlar and similar protections. Further advantageously, use of the gel matrix material should reduce the overall cost for the same level of provided protection.

DETAILED DESCRIPTION

The following merely illustrates the principles of the invention. It will thus be appreciated that those skilled in the art will be able to devise various arrangements that, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

In the claims hereof any element expressed as a means for performing a specified function is intended to encompass any way of performing that function. The invention as defined by such claims resides in the fact that the functionalities provided by the various recited means are combined and brought together in the manner which the claims call for. Applicant thus regards any means which can provide those functionalities as equivalent as those shown herein.

Unless otherwise explicitly specified herein, the drawings are not drawn to scale.

In the description, identically numbered components within different ones of the FIGs. refer to the same components.

Figure 1:
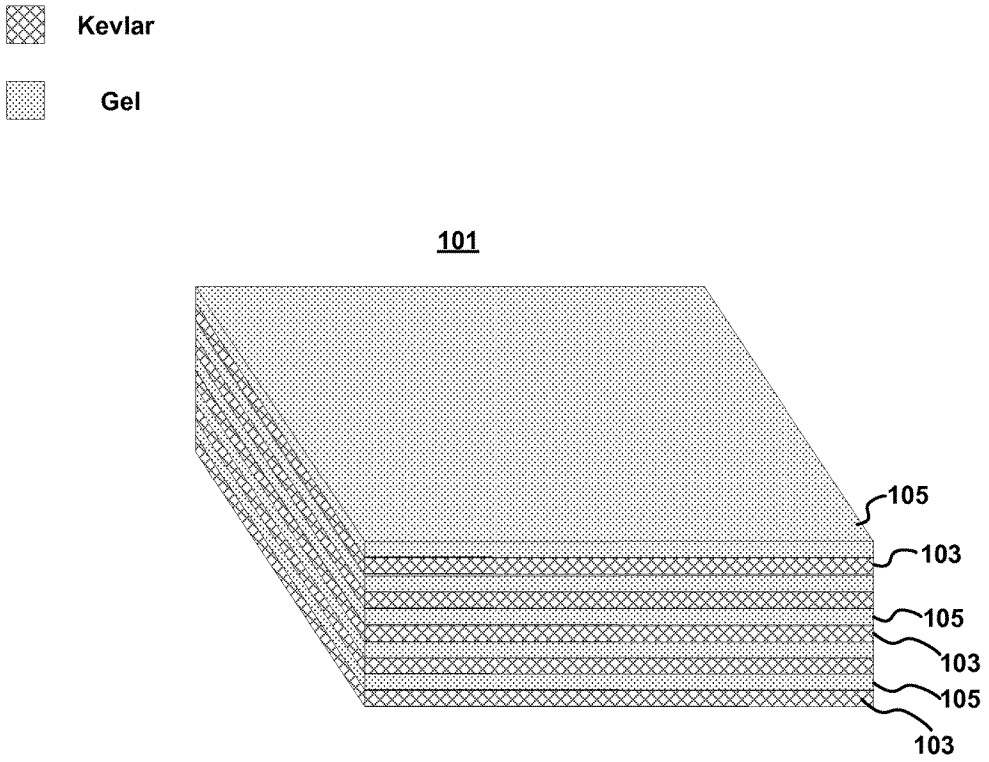
FIG. 1 shows an exemplary material arranged in accordance with the principles of the invention that is capable of stopping high-speed projectiles but yet is sufficiently flexible for various applications such as to be able to be used in footwear to protect a person's feet, especially the bottoms' thereof.

FIG. 1 shows an exemplary material arranged in accordance with the principles of the invention that is capable of stopping high-speed projectiles but yet is sufficiently flexible for various applications such as to be able to be used in footwear to protect a person's feet, especially the bottoms thereof. In accordance with the principles of the invention, enhanced ballistic material 101 is formed from interleaved layers of ballistic material 103 and layers of gel matrix material 105 that remains relatively soft and flexible. Advantageously, enhanced ballistic material 101 is capable of stopping high-speed projectiles but yet is sufficiently flexible to be used in footwear to protect a person's feet, especially the bottoms thereof, and it may be used as well as for other applications, some of which will be further described hereinbelow.

Ballistic material layers 103 may each be made of high tensile strength synthetic or polymeric fibers that are arranged in a mesh weave. Each layer of ballistic material layers 103 is what I call a "weave layer". Each layer of gel matrix material 105 is what I call a "gel layer". The ballistic material of each weave layer may be a) a woven para-aramid, such as KEVLAR®, hereinafter referred to as Kevlar, b) TWARON®, a woven para-aramid, c) an ultra high molecular weight polyethylene (UHMWPE), such as SPECTRA SHIELD®, or d) any mesh weave made to have similar properties. It may also be possible to employ as the ballistic material of the weave layer ballistic plastics, or other ballistic materials, that are not woven. All of the weave layers of a piece of enhanced ballistic material need not be made of the same material or be of the same thickness.

Gel matrix material 105 may be an elastomer, e.g., an elastic polymer or natural rubber, in that it should be a material that is compressible, flexible, and elastic. Preferably the gel matrix material is capable of investing the ballistic material, e.g., through the use of heat and/or pressure. Furthermore, the combined material, i.e., enhanced ballistic material 101, may be shaped, e.g., by molding. For ease of manufacturing, the gel matrix material may be a thermoplastic. Exemplary gel matrix materials include ethylene vinyl acetate, (CAS# 24937-78-8, also known as EVA), neoprene, silicone, rubber, nylon, latex, ELASTOSIL® R 750, a silicone rubber product of Wacker silicones (available at http://www.wacker.com/cms/en/global$_{13}$ contents/search/search.jsp), polyvinylchloride (PVC), polyether, or polyurethane. Those of ordinary skill in the art will be able to select a particular gel matrix material based on the compressibility, flexibility, and thermal properties of the application to which the enhanced ballistic material is to be put. All of the gel layers of a piece of enhanced ballistic material need not be made of the same material or be of the same thickness.

In some layers of conventional bullet proof vests, and the like, a projectile may pass through a layer by enlarging a gap between the fibers, either by tearing some fibers or stretching the fibers, to create, at least temporarily, a space for the projectile to pass through. By contrast, in one embodiment of the invention, where the weave layer is permeable to the gel material, e.g., due to there being some space between adjacent fibers of the weave layer, the weave layer is impregnated with the gel matrix material in a manner that reduces the ability of the fibers to quickly separate from each other, thus increasing resistance to the motion of the projectile. The impregnation may be achieved by heating and pressing the interleaved weave layers and gel layers together.

Advantageously, the gel layer enhances the stopping power of the resulting multi-layer structure as compared to the same number of weave layers without gel material, e.g., by having the gel matrix material fill the interstices of the fibers, while leaving it sufficiently flexible to be comfortable when inserted as in insert in a boot.

Functionally, the gel matrix material reduces the ability of a projectile to stretch and/or spread apart, e.g., when impregnated, the individual fibers of the weave layers at and around the point of impact, thus making it more difficult for the projectile to part or break the fibers, thereby enhancing the resistance of each weave layer to the motion of the projectile. Effectively the layers of gel matrix material reduce the range of motion of the constituent portions, e.g., fibers, as well as of the individual weave layers, which are bound together to form a whole combined unit. Furthermore, the layers of gel matrix material cause the weave layers to at least partially work together in stopping the projectile. This may also contribute to better resistance to the spin of the projectile through the cooperation of all the joined layers.

Because the gel matrix material is elastic, the gel matrix material may also reflect the forward compressive shockwave back at the projectile, thus working to slow the projectile.

Additionally, the gel matrix material provides some spacing between adjacent weave layers. This spacing may be small. However, such spacing prevents the weave layers from pushing against each other as quickly as if there was no space at all, thus allowing each layer of weave material to operate at least somewhat independently in contributing to the slowing of the projectile, thereby sapping the kinetic energy of the projectile in a layer-by-layer fashion and thus improving stopping power. This is different than when there are simply multiple independent adjacent weave layers, because in that situation the projectile forces a more-in-front layer further back and adjacent to the next-further-back layer, thereby eliminating any space that there may originally have been between them, reducing the effective stopping power. Furthermore, the gel matrix material reduces the deformation rate achievable by each layer, thus allowing each layer to more strenuously resist the projectile and thereby slowing it more than each weave layer would achieve by itself. Additionally, the gel matrix material retards the ability of each subsequent weave layer to be dragged through the hole path created by the impact from layer to layer of the projectile, as compared to independent layers of weave material, which often happens for some layers typically after the first few in multi-layer stopping arrangements.

Thus, advantageously, the gel matrix material enhances the stopping power of the resulting multi-layer structure as compared to the same number of weave layers without gel matrix material and yet the resulting multi-layer structure is sufficiently flexible to be comfortable when inserted as in insert in a boot. For example, tests have shown that while it takes 12 layers of conventional Kevlar to stop a 22 caliber long rifle hypervelocity bullet, such a bullet can be stopped by 4 to 6 layers of enhanced ballistic material, e.g., 6 layers of Kevlar and 5 layers of silicon. Thus, advantageously, not only a) is the enhanced ballistic material more comfortable due to its flexibility, and b) better suited to be in close contact with the body, but c) it is also significantly stronger than conventional Kevlar and similar protections. Further advantageously, use of the gel matrix material should reduce the overall cost for the same level of provided protection.

Figure 2:
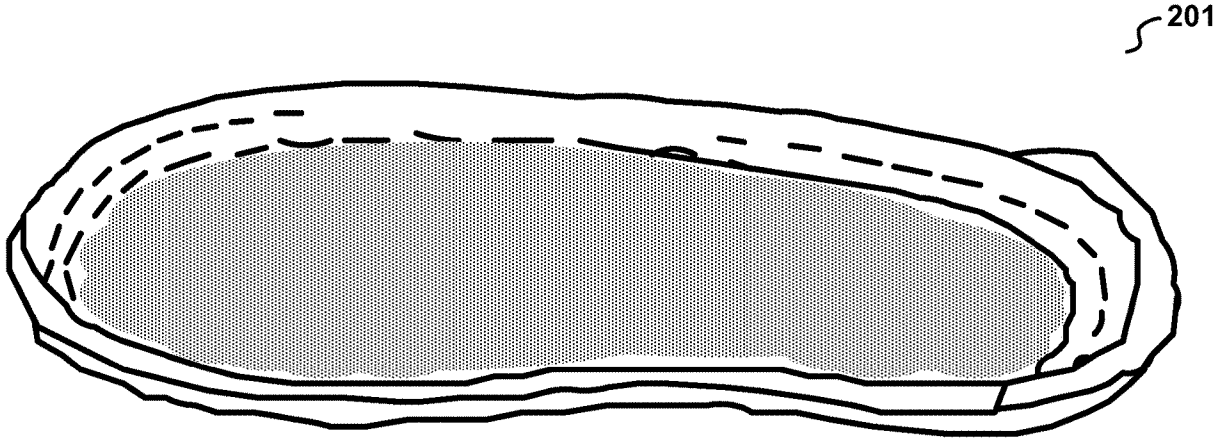
FIG. 2 shows a three-dimensional view of an insert made of the enhanced ballistic material of FIG. 1 that is shaped to be suitable for use in the boot of a soldier in order to provide protection from an underfoot explosion.

FIG. 2 shows a three-dimensional view of insert 201 made of enhanced ballistic material 101 that is shaped to be suitable for use in the boot of a soldier in order to provide protection from an underfoot explosion. Typically insert 201 is place between the bottom of the foot, or portion of the sock surrounding the bottom of the foot, and the inside bottom portion of the shoe. Preferably, at least the bottom layer of insert 201, with respect to a foot under which the material is located, is a Kevlar layer. Such inserts may be 1) provided integrally with each boot, 2) provided concurrently with the boots, or 3) provided as a so-called after-market product or accessory that is available for purchase for insertion into completed boots that are purchased separately, e.g., as a retrofit to existing boots.

It is recommended that insert 201 have rim 203 that is sized so that it comes up slightly to partly envelop the soldier's foot when it is inserted into a boot containing the insert so as to provide additional protection for the soldier's foot. To this end, it is further recommended that a soldier wear a boot that is somewhat larger, e.g., one-half size larger, than he would otherwise wear, to allow sufficient room to fit insert 201 into the boot.

To protect a soldier's foot against the risk of fire in the event of an explosion underfoot, the gel matrix material is preferably fireproof or the layer that is ultimately adjacent to the soldier's foot or sock should preferably be a fire resistant weave layer, such as Kevlar. Advantageously, the inventive material further contributes to shielding the wearer's foot from heat that can cause bodily injury, such as burns, melting of flesh, and fusing of flesh to clothing and footwear. Such heat is typically generated in proximity to an explosion, which may launch high-speed projectiles, or may be the result of a fire.

For the wearer's comfort, it is possible to use in the layer that is against the wearer's foot a material that provides odor and antibacterial protection such as MICROBAN® protection products, which are available from Microban International Ltd., a global technology company headquartered in North America with an office located at 11400 Vanstory Drive, Huntersville, N.C. 28078, United States; Tel: +1 (704) 875-0806; and a website at www.microban.com.

Note that the properties of the layer closest to the wearer's foot would be selected by designer based on the particular threats expected to be encountered and protected against in the event that a suitable material for countering all the conditions cannot be selected. For example, in some applications where fire is expected, e.g., where there is a high risk of explosion, a fire resistant material may be selected, whereas when the risk of explosion is minimal but there is likely to be sweat odor an antibacterial protection may be selected in the event both protections cannot be adequately provided simultaneously.

Figure 3:
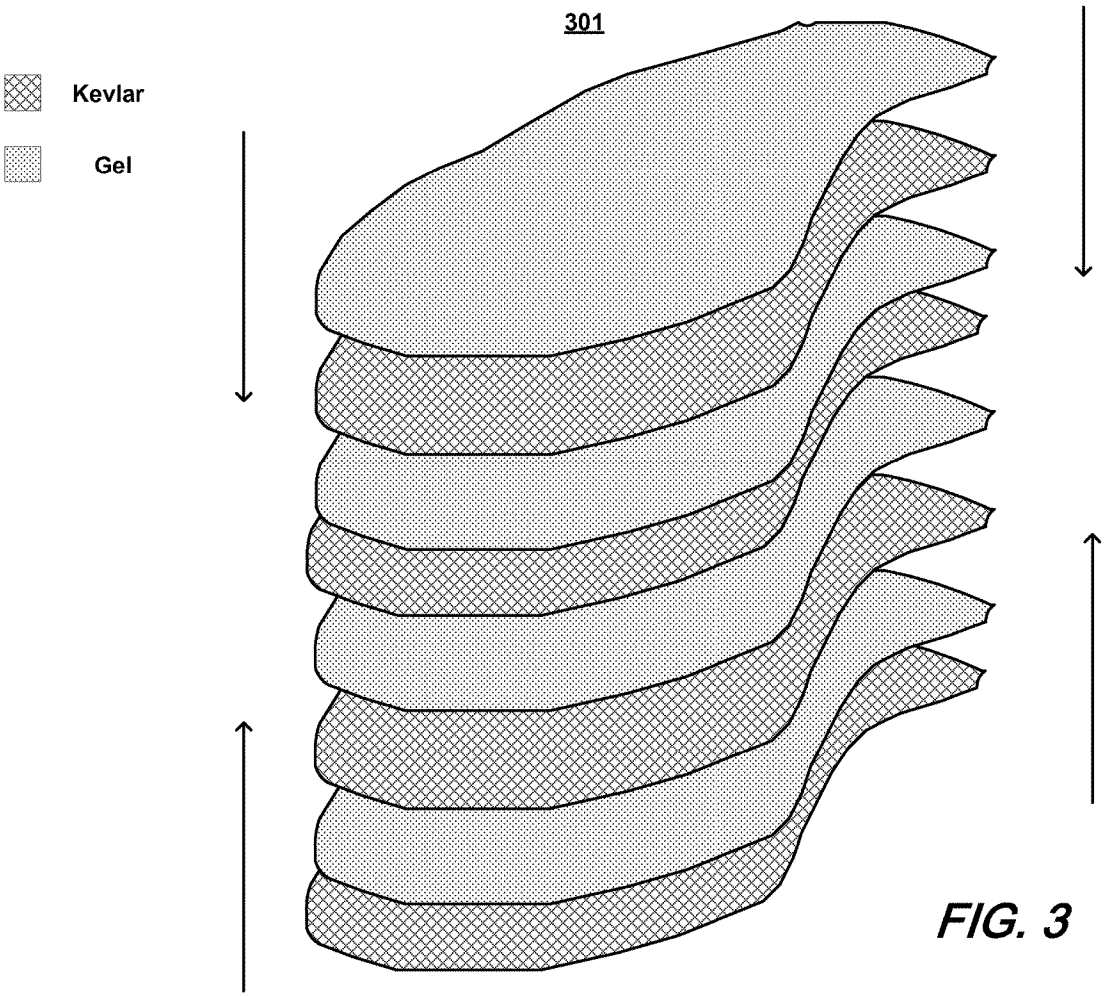
FIG. 3 shows an exploded view of the insert of FIG. 2.

FIG. 3 shows an exploded view of insert 201 of FIG. 2. In accordance with an aspect of the invention, the layers of gel matrix material 105 may already be solidified and, optionally, shaped, prior to assembly of insert 201. Alternatively, insert 201 may be formed and shaped from a sheet of enhanced ballistic material 101. To form enhanced ballistic material 101, the layers of ballistic material 103 and the layers of gel matrix material 105 may be heated and pressed together.

For example, interleaved layers of ballistic material 103 and the layers of gel matrix material 105 are first placed in a mold, which is then pressed together and heated to form the desired shape. To this end, layers of gel material may be sprayed, brushed or applied to each lower layer of ballistic material to insure that the ballistic material is appropriately covered by the gel material. Of course, one of ordinary skill in the art will readily recognize that the final thickness of the gel matrix material layers may, at least in part, depend on the amount of pressure and the heat applied.

Returning to FIG. 1, in another embodiment of the invention, a layer of gel matrix material 105 may be liquid or semisolid and placed between two layers of ballistic material 103, which may then be pressed together and cured. Also, within one piece of an enhanced ballistic material 101, each layer of ballistic material 103 may, but need not, be made of the same material or of the same thickness Likewise, within one piece of an enhanced ballistic material 101, each layer of gel matrix material 105 may, but need not, be made of the same material or of the same thickness. The particular materials and thickness thereof will depend on the particular application to which the enhanced ballistic material is to be put.

The enhanced flexible ballistic material could also be used for vehicle floor mats, e.g., for school buses, armored vehicles, cars, trucks, Humvees, boats, trains, plains, and the like, to protect such vehicles from explosions, e.g., mines or improvised explosive devices (IEDs). Other applications may include use of the enhanced ballistic material as a) the inner liner of a helmet; b) a liner for a vest; c) part of the protective suit worn by tank personnel, e.g., as a replacement for one or more layers thereof; d) an elbow or knee pad, e) an ankle protector, f) an arm pit protector, h) a face mask, i) a space suit liner; j) a space craft wall, e.g., to provide interior or exterior, protection; k) a seat cushion, l) a hull, or liner thereof, of a watercraft, m) a fuselage, or liner thereof, of an aircraft, or n) part of a wetsuit or dry suit, o) the like where protection is required but some degree of softness and/or flexibility would be desirable. Note that an advantage of using the enhanced ballistic material in space applications is that the matrix material can be made airtight and one or more of the inner layers can remain airtight even after the stopping of small bits of space debris by the outer layers.

As noted hereinabove, the amount of gel matrix material in between each layer of ballistic material depends on the application of the enhanced ballistic material. In particular, tradeoffs between softness, stopping power, thickness, weight, durability, and material cost are required. Thus, for example, a boot liner needs to provide flexibility, durability in maintaining its shape as it is constantly walked upon, relatively light weight, moderate softness, compactness, and good stopping power. A bus floor liner need not be especially soft, e.g., less soft than the boot application, it may be heavy and need not be compact so it may have many layers, it should be as durable as the floors of buses typically are, is barely flexible, in that it is meant as a soft liner for a hardened compartment, and has the most stopping power. A helmet liner, which is intended to prevent a catastrophic failure of the helmet from killing the wearer, should be lightweight and soft but need not be compact or durable.

A unique approach to helmet design and space craft walls is to take individual layers of enhanced ballistic material and interleave between them layers of foam to increase the softness and reduce the weight. Preferably the foam is made from the same material that is employed for the gel material of the enhanced ballistic material to provide improved chemical matching and bonding.

Preferably, the ballistic material layer should be evenly spaced over the entirety of the thickness of the enhanced ballistic material.

What is claimed is:

1. A material formed in a shape of an insert for a boot, said material being adapted to stop high-speed projectiles, said material comprising a plurality of layers of woven high tensile strength fibers interleaved amongst a plurality of gel matrix material layers, said layers of high tensile fibers and gel matrix material being fused together, such that said material is flexible;

wherein the stopping power of the resulting fused multilayer structure with respect to high-speed projectiles is greater than the stopping power with respect to high-speed projectiles of the number of layers of high tensile strength fibers in said material alone;

wherein said interleaved layers of woven high tensile strength fibers and gel matrix material were fused together in a mold such that said material is molded into, and retains, a non-flat molded shape; and wherein said non-flat molded shape is said boot insert shape.

2. The invention as defined in claim 1 wherein said insert is sized and adapted as to curl up around a foot that is inserted within said boot.

3. The invention as defined in claim 1 wherein said high tensile strength fibers are synthetic fibers.

4. The invention as defined in claim 1 wherein said high tensile strength fibers are polymeric fibers.

5. The invention as defined in claim 1 wherein each layer of said woven high tensile strength fibers includes high tensile strength fibers from at least one of the group of high tensile strength fiber types consisting of: (i) a para-aramid and (ii) an ultra high molecular weight polyethylene.

6. The invention as defined in claim 1 wherein said gel matrix impregnates said fibers.

7. The invention as defined in claim 1 wherein said fibers are invested by the gel matrix.

8. The invention as defined in claim 1 wherein said gel matrix material is a thermoplastic.

9. The invention as defined in claim 1 wherein said the gel matrix material is one from the group consisting of: (i) ethylene vinyl acetate, CAS# 24937-78-8, (ii) neoprene, (iii) rubber, (iv) nylon, (v) latex, (vi) silicone rubber, (vii) polyvinylchloride, (viii) polyether, (ix) silicone, and (x) polyurethane.

10. The invention as defined in claim 1 wherein said interleaved layers of woven high tensile strength fibers and gel matrix material were fused together using at least one of (i) heat and (ii) pressure.

11. The invention as defined in claim 1 wherein said interleaved layers of woven high tensile strength fibers and gel matrix material were fused together so as to form a unitary structure.

12. The invention as defined in claim 1 wherein said material is the sole provider of antiballistic protection against said high-speed projectiles for an article into which said material is incorporated.

13. A material formed in a shape of an insert for a boot, said material being adapted to stop high-speed projectiles, said material comprising a plurality of layers of woven high tensile strength fibers interleaved with a plurality of gel layers, said interleaved layers forming said material being fused together as a result of the application of at least one of (i) heat and (ii) pressure such that said material is flexible and wherein the stopping power with respect to high-speed projectiles of the resulting multilayer fused structure of said material is greater with respect to high-speed projectiles than the stopping power of the number of layers of high tensile strength fibers in said material alone;

wherein said interleaved layers of woven high tensile strength fibers and gel matrix material were fused together in a mold such that said material is molded into, and retains, a non-flat molded shape; and wherein said non-flat molded shape is said boot insert shape.

14. The invention as defined in claim 13 wherein each of said gel layers is comprised of at least one gel matrix material.

15. The invention as defined in claim 13 wherein said material is the sole provider of antiballistic protection against said high-speed projectiles for an article into which said material is incorporated.

16. A material formed in a shape of an insert for a boot, said material being adapted to stop high-speed projectiles, said material comprising a plurality of weave layers each being interleaved by one or more gel layers, said layers being fused together;

wherein said interleaved layers of woven high tensile strength fibers and gel matrix material were fused together in a mold such that said material is molded into, and retains, a non-flat molded; and wherein said non-flat molded shape is said boot insert shape.

17. The invention as defined in claim 16 wherein said material is the sole provider of antiballistic protection against said high-speed projectiles for an article into which said material is incorporated.

18. A material formed in a shape of an insert for a boot, said material being adapted to stop high-speed projectiles, said material being made by:

interleaving a plurality of weave layers of high tensile strength fibers with one or more gel layers;

investing said weave layers with gel matrix material of said one or more gel layers by applying at least one of heat and pressure so as to form an enhanced ballistic material; and fusing said interleaved layers of woven high tensile strength fibers and gel matrix material together in a mold such that said material is molded into, and retains, a non-flat molded shape;

wherein said non-flat molded shape is said boot insert shape.

* * * * *